US009963879B2

(12) United States Patent
Thiagarajan et al.

(10) Patent No.: US 9,963,879 B2
(45) Date of Patent: May 8, 2018

(54) MULTIWALL POLYMER SHEET, AND METHODS FOR MAKING AND ARTICLES USING THE SAME

(75) Inventors: Chinniah Thiagarajan, Bangalore Karnataka (IN); Frans Adriaansen, Bergen Op Zoom (NL); Eelco van Hamersveld, Raamsdonksveer (NL)

(73) Assignee: SABIC GLOBAL TECHNOLOGIES B.V., Bergen Op Zoom (NL)

( * ) Notice: Subject to any disclaimer, the term of this patent is extended or adjusted under 35 U.S.C. 154(b) by 2994 days.

(21) Appl. No.: 11/668,732

(22) Filed: Jan. 30, 2007

(65) Prior Publication Data

US 2008/0182047 A1 Jul. 31, 2008

(51) Int. Cl.
*E04C 2/54* (2006.01)
*E04D 3/06* (2006.01)

(52) U.S. Cl.
CPC ..... *E04D 3/06* (2013.01); *E04C 2/543* (2013.01); *Y10T 428/24174* (2015.01)

(58) Field of Classification Search
CPC ..... B32B 3/12; B32B 37/146; E04C 2/543; E04C 2/34; E04C 2/365; B29L 2031/60;
(Continued)

(56) References Cited

U.S. PATENT DOCUMENTS 2,793,718 A * 5/1957 Pajak ..... 428/118
2,858,734 A * 11/1958 Boyd ..... 359/593
(Continued)

FOREIGN PATENT DOCUMENTS

EP 1543945 A1 6/2005
EP 1316407 A1 6/2006
(Continued)

OTHER PUBLICATIONS

Intersect. (n.d.). The American Heritage® Dictionary of the English Language, Fourth Edition. Retrieved Dec. 22, 2009, from Dictionary.com website: http://dictionary.reference.com/browse/intersect.*
(Continued)

*Primary Examiner* — Brian E Glessner
*Assistant Examiner* — Joshua K Ihezie
(74) *Attorney, Agent, or Firm* — Cantor Colburn LLP

(57) ABSTRACT

In one embodiment, a multiwall sheet comprises: non-intersecting polymer walls comprising outer layers and transverse layers. The transverse layers intersect the walls to form cells. The multiwall sheet has a non-uniform cell density. In another embodiment, a multiwall sheet can comprise: non-intersecting polymer walls comprising outer layers and a transverse layer and/or a divider. The transverse layer and/or the divider extends from one of the polymer walls to another of the polymer walls to form cells. The multiwall sheet has a non-uniform cell density. In yet another embodiment, a multiwall sheet comprises: non-intersecting polymer walls comprising outer layers and transverse layers. The transverse layers intersect the walls to form cells. The multiwall sheet has a different number of inner layers, transverse layers, and/or dividers, in different portions of the sheet. The multiwall sheets can be used, for example, in a naturally light structure.

14 Claims, 4 Drawing Sheets

(58) Field of Classification Search
CPC ..... B29L 2031/608; E04D 3/06; Y10T 428/24174
USPC ..... 52/200, 783.1, 783.11, 783.14, 791.1, 52/307, 308; 428/34, 120, 166, 188, 119; 359/619, 621, 620, 622, 623, 593, 595
See application file for complete search history.

(56) References Cited

U.S. PATENT DOCUMENTS

| | | | | |
|---|---|---|---|---|
| 3,533,894 | A * | 10/1970 | Emerson et al. | 428/118 |
| 4,242,849 | A * | 1/1981 | Benkelman et al. | 52/745.15 |
| 4,335,551 | A * | 6/1982 | Benkelman et al. | 52/200 |
| 5,052,164 | A * | 10/1991 | Sandow | 52/786.13 |
| 5,182,158 | A * | 1/1993 | Schaeffer | 428/178 |
| 5,348,790 | A * | 9/1994 | Ben-Zvi et al. | 428/178 |
| 5,509,250 | A * | 4/1996 | Jensen et al. | 52/200 |
| 5,664,395 | A * | 9/1997 | Collins et al. | 52/786.13 |
| 5,776,562 | A | 7/1998 | Schwarz | |
| 5,944,935 | A * | 8/1999 | Zukas et al. | 156/285 |
| 5,972,475 | A * | 10/1999 | Beekman | 428/167 |
| 6,413,458 | B1 * | 7/2002 | Pearce | 264/141 |
| 6,442,282 | B2 * | 8/2002 | Azima et al. | 381/152 |
| 6,500,516 | B2 * | 12/2002 | Bourlier et al. | 428/116 |
| 6,584,740 | B2 * | 7/2003 | Record | 52/270 |
| 2001/0011442 | A1 * | 8/2001 | Phin | 52/309.1 |
| 2001/0053230 | A1 * | 12/2001 | Azima et al. | 381/152 |
| 2004/0191485 | A1 * | 9/2004 | Groothues et al. | 428/166 |
| 2005/0112331 | A1 * | 5/2005 | Donea et al. | 428/166 |
| 2005/0120646 | A1 * | 6/2005 | Konstantin | 52/200 |
| 2007/0248792 | A1 * | 10/2007 | Conterno | 428/116 |

FOREIGN PATENT DOCUMENTS

| | | | |
|---|---|---|---|
| GB | 2296729 | A | 7/1996 |
| GB | 2344118 | A | 5/2000 |
| WO | 9922090 | A1 | 5/1999 |

OTHER PUBLICATIONS

International Standard ISO 9050, Second Edition Aug. 15, 2003, Glass in building—Determination of light transmittance, solar direct transmittance, total solar energy transmittance, ultraviolet transmittance and related glazing factors.

U.S. Appl. No. 11/403,590, filed Apr. 13, 2006; Chinniah Thiagarajan et al.; "Polymer Panels and Methods of Making the Same"; Available in the Image File Wrapper (IFM) in PAIR.

U.S. Appl. No. 11/463,927, filed Aug. 11, 2006; Frederik Hoolhorst et al.; "Polymer Sheeting"; Available in the Image File Wrapper (IFM) in PAIR.

International Search Report; International Application No. PCT/US2008/052424; dated Jun. 24, 2008; 7 pages.

Written Opinion of the International Searching Authority; International Application No. PCT/US2008/052424; dated Jun. 24, 2008; 10 pages.

European Publication No. 1316407 A1; Date of Publication: Jun. 4, 2003; Abstract Only; 1 page.

* cited by examiner

MULTIWALL POLYMER SHEET, AND METHODS FOR MAKING AND ARTICLES USING THE SAME

TECHNICAL FIELD

The present disclosure relates generally to polymer sheets, and more specifically to multiwall polymer sheets.

BACKGROUND

In the construction of naturally lit structures (e.g., greenhouses, pool enclosures, conservatories, stadiums, sunrooms, and so forth), glass has been employed in many applications as transparent structural elements, such as, windows, facings, and roofs. However, polymer sheeting is replacing glass in many applications due to several notable benefits.

One benefit of polymer sheeting is that it exhibits excellent impact resistance compared to glass. This in turn reduces maintenance costs in applications wherein occasional breakage caused by vandalism, hail, contraction/expansion, and so forth, is encountered. Another benefit of polymer sheeting is a significant reduction in weight compared to glass. This makes polymer sheeting easier to install than glass and reduces the load-bearing requirements of the structure on which they are installed.

In addition to these benefits, one of the most significant advantages of polymer sheeting is that it provides improved insulative properties compared to glass. This characteristic significantly affects the overall market acceptance of polymer sheeting as consumers desire a structural element with improved efficiency to reduce heating and/or cooling costs.

Although the polymer sheeting has many advantages over glass, there is a continuous demand for enhanced insulative properties and/or structural properties without an increase in weight and/or thickness.

BRIEF SUMMARY

Disclosed herein are multiwall sheeting, and method for making and uses thereof.

In one embodiment, a multiwall sheet comprises: non-intersecting polymer walls comprising outer layers and transverse layers. The transverse layers intersect the walls to form cells. The multiwall sheet has a non-uniform cell density.

In another embodiment, a multiwall sheet can comprise: non-intersecting polymer walls comprising outer layers and a transverse layer and/or a divider. The transverse layer and/or the divider extends from one of the polymer walls to another of the polymer walls to form cells. The multiwall sheet has a non-uniform cell density.

In yet another embodiment, a multiwall sheet comprises: non-intersecting polymer walls comprising outer layers and transverse layers. The transverse layers intersect the walls to form cells. The multiwall sheet has a different number of inner layers, transverse layers, and/or dividers, in different portions of the sheet.

In one embodiment, a naturally light structure can comprise: a building structure and a roof comprising a multiwall sheet. The multiwall sheet can comprise non-intersecting polymer walls comprising outer layers and transverse layers. The transverse layers intersect the walls to form cells. The multiwall sheet can have a non-uniform cell density.

In one embodiment, the multiwall sheet can be formed via extrusion.

The above described and other features are exemplified by the following figures and detailed description.

BRIEF DESCRIPTION OF THE DRAWINGS

Refer now to the figures, which are exemplary embodiments, and wherein the like elements are numbered alike.

DETAILED DESCRIPTION

Figure 1:
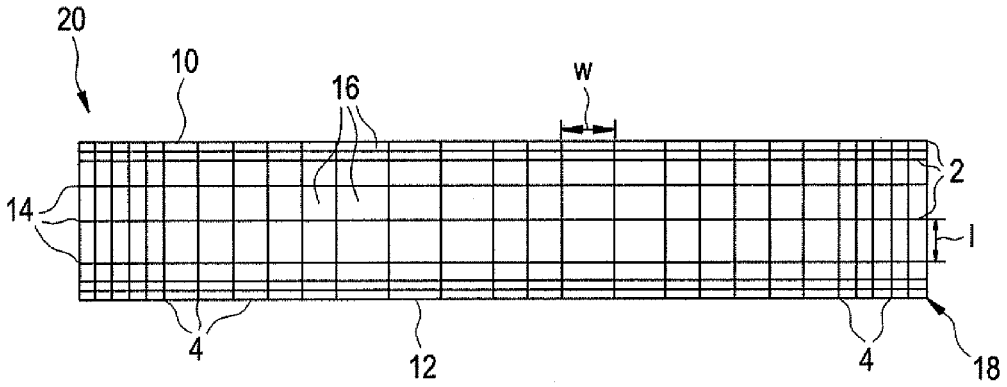
FIG. 1 is a cross-sectional side view of an exemplary embodiment of a 9 layer multiwall sheet having a cell size gradient.

Disclosed herein is polymeric sheeting that can offer improved insulative properties and/or structural performance without increasing thickness or density. Although consumers seek greater insulative properties, they are not willing to accept higher densities and/or thicknesses, and/or reduced structural integrity. Consumers desire improvements, without sacrificing any current properties. The disclosed multiwall sheet, at a set density and thickness, has enhanced insulative properties (e.g., greater than or equal to 20% improvement), while also enhancing structural performance (e.g., greater than or equal to about 100% improvement). In the embodiments of the current multiwall sheet, the sheet has reduced cell sizes and wall thickness and/or a cell size gradient that decreases from the center (or middle) of the sheet toward the top and/or bottom of the sheet, and/or from the center of the sheet toward one or both ends of the sheet.

In one embodiment, a multiwall sheet comprises: non-intersecting polymer walls comprising outer layers and transverse layers. The transverse layers intersect the walls form cells. The multiwall sheet has a non-uniform cell density.

In another embodiment, a multiwall sheet can comprise: non-intersecting polymer walls comprising outer layers and a transverse layer and/or a divider. The transverse layer and/or the divider extends from one of the polymer walls to another of the polymer walls to form cells. The multiwall sheet has a non-uniform cell density.

In yet another embodiment, a multiwall sheet comprises non-intersecting polymer walls comprising outer layers and transverse layers. The transverse layers intersect the walls to form cells. The multiwall sheet has a different number of inner layers, transverse layers, and/or dividers, in different portions of the sheet.

In one embodiment, a naturally light structure can comprise: a building structure and a roof comprising a multiwall sheet. The multiwall sheet can comprise non-intersecting polymer walls comprising outer layers and transverse layers. The transverse layers intersect the walls to form cells. The multiwall sheet can have a non-uniform cell density.

In some embodiments, the cell density in a middle of the sheet is about 10% to about 60% of a cell density adjacent the outer layers, or, more specifically, about 15% to about 50% of the cell density adjacent the outer layers, or, yet more specifically, about 20% to about 40% of the cell density adjacent the outer layers. The multiwall sheet can have a cell size gradient such that the cell size increases toward a center of the multiwall sheet. The cells can have a decreasing size from the middle to toward the ends of the sheet and/or a decreasing size from the middle to toward the outer layers. The cells can also have a length and/or width of less than or equal to about 2 mm. The transverse layers can have a thickness of about 0.1 mm to about 1 mm. Also, the polymer walls and/or the transverse layers can comprise micro-features and/or nano-features. The multiwall sheet can have a stiffness of greater than or equal to about 4,000 N/mm, or, more specifically, greater than or equal to about 5,000 N/mm, or, even more specifically, greater than or equal to 6,000 N/mm. The multiwall sheet can comprise a U-value of less than or equal to about 1.2 $W/m^2K$ at a nominal volume density of less than or equal to about 180, or, more specifically, less than or equal to about 1.0 $W/m^2K$.

The multiwall sheet can be used in various applications. For example, a greenhouse can comprise a building structure and a roof comprising the multiwall sheet. In one embodiment, a multiwall sheet comprises: greater than or equal to three polymer walls (e.g., comprising a first outer layer, a second outer layer, and inner layer(s), wherein the polymer walls can be disposed substantially parallel to one another (e.g., they can be disposed such that they do not intersect)), and transverse layer(s).

The number of layers of the multiwall sheet is dependent upon customer requirements such as structural integrity, overall thickness, light transmission properties, and insulative properties. The overall thickness of the multiwall sheet can be less than or equal to about 55 millimeters (mm) or even thicker, or more specifically about 1 mm to about to about 45 mm, or, even more specifically, about 3 mm to about 35 mm, or, even more specifically, about 3 mm to about 25 mm, and yet more specifically, about 5 to about 15 mm. The multiwall sheets have at least 2 layers, or more specifically, greater than or equal to 3 layers (e.g., main layers) (e.g., see FIGS. 1-5, walls 2), or, even more specifically, about 3 layers to about 30 layers, and, yet more specifically, about 4 layers to about 25 layers, and yet more specifically, about 5 to about 15 layers. The layers can each have a thickness of less than or equal to about 1 mm, or, more specifically, about 0.05 mm to about 0.9 mm, or, even more specifically, about 0.1 mm to about 0.8 mm.

Additionally, the sheet has a sufficient number of transverse layers to attain the desired structural integrity. In addition to the main layers and the transverse layers (e.g., also known as dividers or ribs) can be employed (e.g., see FIGS. 1-3, transverse layers 4). The dividers can have various geometries such as perpendicular (e.g., see FIGS. 1-3) a cross (e.g., X) geometry (e.g., see FIG. 3, X dividers 6), a portion of the X (a "V") geometry (see FIG. 2), a sinusoidal geometry (e.g., see FIG. 4, sinusoidal divider 8), as well as any other geometry and combinations comprising at least one of these geometries. The transverse layers can each have a thickness of less than or equal to about 1 mm, or, more specifically, about 0.05 mm to about 0.8 mm, or, even more specifically, about 0.1 mm to about 0.6 mm.

Figure 5:
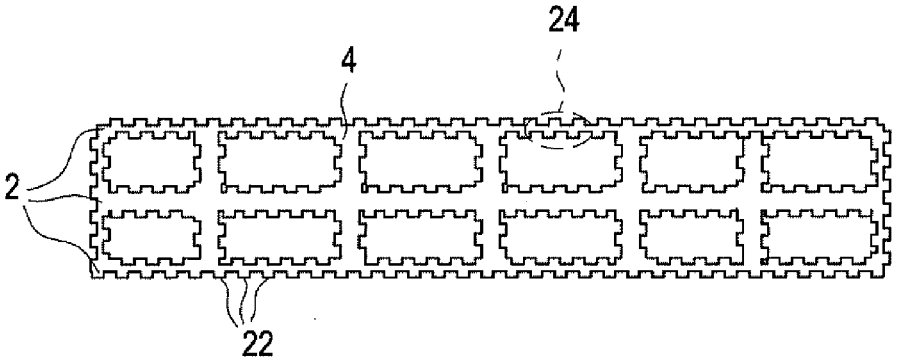
FIG. 5 is a cross-sectional side view of an exemplary embodiment of a 3 layer multiwall sheet having micro-features on the walls and dividers.
Figure 6:
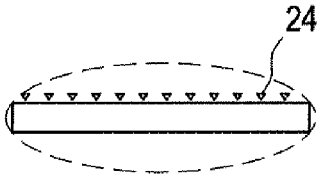
FIGS. 6 and 7 are exemplary exploded views of portion 24 of FIG. 5 illustrating different micro-feature geometries.
Figure 7:
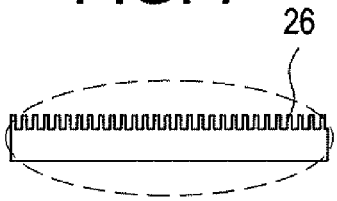
Figure 8:
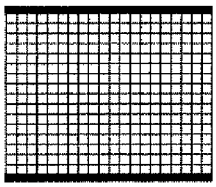
FIGS. 8-12 are cross-sectional side views of multiwall sheet configurations illustrating the multiwall sheets employed for Samples 1-5, respectively, in the Examples.
Figure 9:
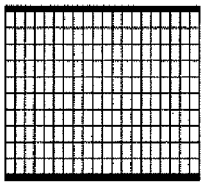
Figure 10:
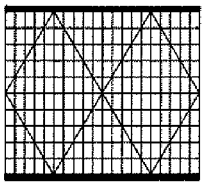
Figure 12:
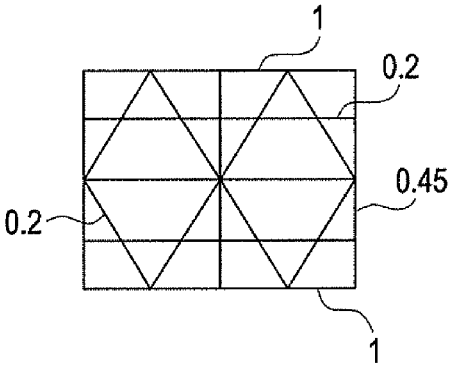
Figure 11:
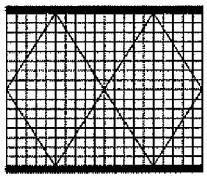

The walls 2 and/or transverse layers 4 can also comprise micro-features 22 (and/or nano-features) on one or more surfaces thereof, also referred to as gratings (see FIG. 5). These micro-features can have a variety of sizes and shapes, as is illustrated in FIGS. 6 and 7. For example, in addition to the saw tooth-shaped cross-sectional geometries illustrated, the surface features can comprise polygonal forms (e.g., square-wave, trapezoidal, saw-tooth, off-set saw tooth, triangular, pyramidal, prismatic), curved forms (e.g., sinusoidal, arcs, bumps, dimples, cones), polyhedrons (e.g., any multi-faced three dimensional geometry), irregular shapes, and so forth, as well as combinations comprising at least one of the foregoing, such as micro-features that direct, diffuse, and/or polarize light. Exemplary features and methods for forming the features, e.g., coating and/or extrusion, are further discussed commonly assigned in U.S. patent application Ser. No. 11/403,590, filed Apr. 13, 2006.

The insulative properties of the sheet can be determined via the sheet's U-value. To be specific, the U-value is the amount of thermal energy that passes across 1 square meter of the sheet at a temperature difference between both sheet sides of 1 Kelvin (K). The U-value can be determined according to ISO 10292 (1994(e)). The U-value is calculated according to the following formula (I):

$$U=1/h_e+1/h_t+1/h_i \quad \text{(I)}$$

wherein: $h_e$=external heat transfer coefficient
$h_t$=internal heat transfer coefficient
$h_i$=conductance of the multiple glaze unit $$\frac{1}{h_i}=\sum^{N}\frac{1}{h_s}+\sum^{M}d_m r_m$$

where:
$h_s$=the gas space conductance;
N=the number of spaces;
M=the number of materials;
$d_m$=the total thickness of each material;
$r_m$=the thermal resistivity of each material (the thermal resistivity of glass is 1 m·K/W)

$$h_s=h_g+h_r$$

where:
$h_r$=the radiation conductance;
$h_g$=the gas conductance (conduction and convection)

The radiation conductance, $h_r$, is given by $$h_r=4\sigma\left(\frac{1}{\varepsilon_1}+\frac{1}{\varepsilon_2}-1\right)^{-1}\cdot T_m^3$$

where:

σ=the Stefan-Boltzmann constant $\epsilon_1$ and $\epsilon_2$=the corrected emissivities at mean absolute temperature $T_m$ of the gas space The gas conductance, $h_g$, is given by $$h_g = Nu\frac{\lambda}{s}$$

where:

s=the width of the space, in meters (m);

λ=the gas thermal conductivity, in watts per meter Kelvin [W/(m·K)];

Nu=the Nusselt number, given by $$Nu=A(Gr\cdot Pr)^n$$

where:

A=a constant;

Gr=a Grashof number;

Pr=a Prandtl number;

n=an exponent $$Gr = \frac{9.81s^3\Delta Tp^2}{T_m\mu^2}$$

$$Pr = \frac{\mu c}{\lambda}$$

where:

ΔT=the temperature difference on either side of the glazing, in Kelvins (K), p=the gas density, in kilograms per cubic meter (kg/m$^3$), c=the gas specific heat, in joules per kilogram Kelvin [J/(kg·K)], $T_m$=the gas mean temperature, in Kelvins (K)

Due to the design of the multiwall sheet, the sheet, at a set thickness and density, has a U-value of less than or equal to about 1.2 watts per square meter Kelvin (W/m$^2$K), or, more specifically, less than or equal to about 1.0 W/m$^2$K, or, even more specifically, less than or equal to about 0.75 W/m$^2$K, or, yet more specifically, less than or equal to about 0.50 W/m$^2$K, and, even more specifically, less than or equal to about 0.40 W/m$^2$K, at a nominal volume density of less than or equal to about 180. It is also noted, that the U-value was attained while improving stiffness to greater than or equal to about 4,000 Newtons per millimeter (N/mm), or, more specifically, greater than or equal to about 5,000 N/mm, or, even more specifically, greater than or equal to about 6,000 N/mm, and even greater than or equal to about 6,500 N/mm, at a density of about 5.0 to about 6.5 kilograms per square meter (kg/m$^2$).

In one embodiment, a method for producing a multiwall sheet comprises: forming at least two walls and a transverse layer therebetween and increasing insulative properties and structural integrity of the sheet while maintaining overall density and thickness. Referring now to FIG. 1, a partial cross-sectional view of an exemplary multiwall has main layers 2 comprising a first outside layer (e.g., a top layer) 10 and a second outside layer (e.g., bottom layer) 12 that are connected by transverse layers (e.g., ribs) 4. The top layer 10 and the bottom layer 12, as well as inner layer(s) 14, are generally parallel with respect to each other. The transverse layer(s) 4 are generally disposed between, and normal to, the top layer 10 and the bottom layer 12.

Figure 2:
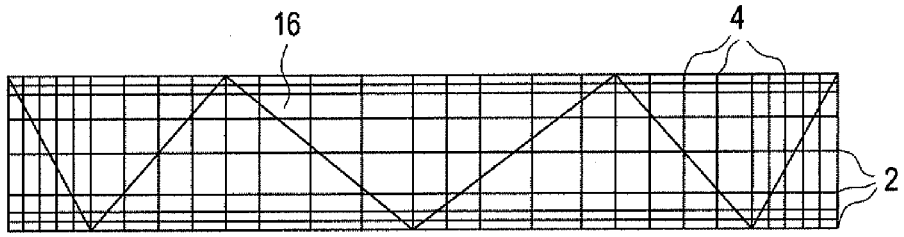
FIG. 2 is a cross-sectional side view of another exemplary embodiment of a 9 layer multiwall sheet having a cell size gradient and "V" dividers.
Figure 3:
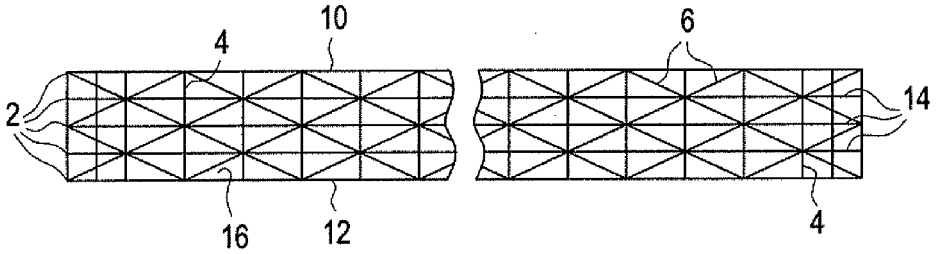
FIG. 3 is a cross-sectional side view of an exemplary embodiment of a 5 layer multiwall sheet having a different cell size at the ends of the multiwall sheet, and having X dividers.
Figure 4:
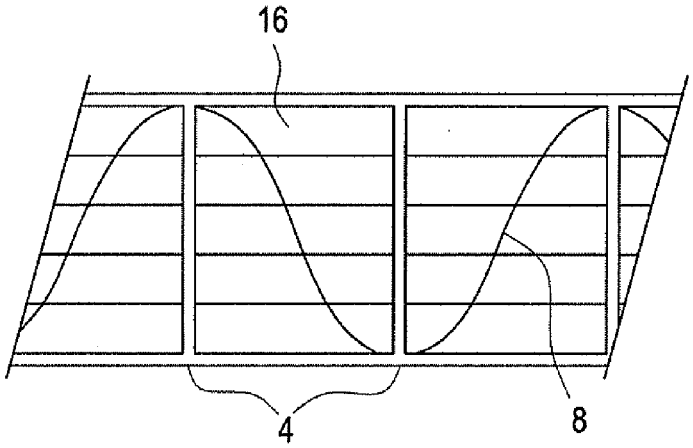
FIG. 4 is a cross-sectional side view of an exemplary embodiment of a 6 layer multiwall sheet having sinusoidal dividers.

The multiwall sheet comprises multiple cells 16 that are defined by adjacent transverse layers 4 and main layers 2, with each sheet comprising a plurality of the cells 16. In some embodiments, the cells can have a length, "l", of less than or equal to about 2 mm. The cells can have a width, "w", of less than or equal to about 2 mm. For example, the cells can have a length, "l", of less than or equal to about 100 micrometers (μm), or, more specifically, less than or equal to about 50 μm, or, even more specifically, less than or equal to about 10 μm, and, yet more specifically, less than or equal to about 2 μm. The cells can have a width, "w", of less than or equal to about 100 micrometers (μm), or, more specifically, less than or equal to about 50 μm, or, even more specifically, less than or equal to about 10 μm, and, yet more specifically, less than or equal to about 2 μm. For example, the cells can have a size (l by w) of 1 μm×1 μm, or 4 μm×1 μm. As is illustrated in FIGS. 1 and 2, the cells can have a size gradient. The size gradient can decrease toward the first outer layer 10 and/or second outer layer 12 and/or first end 18 and/or second end 20. In other words, the cell density (number of cells per unit area) can be non-uniform across the sheet; e.g., can increase towards the outer areas of the sheet (e.g., from the middle toward the first outer layer 10 and/or second outer layer 12 and/or first end 18 and/or second end 20), with optional dividers (e.g., diagonal ribs (X, V, and so forth)) employed for flexural rigidity and/or torsional rigidity. In some embodiments, the cell density in the middle of the sheet can be about 10% to about 60% of the cell density adjacent the outer layer(s), or, more specifically, about 15% to about 50% of the cell density adjacent the outer layer(s), or, yet more specifically, about 20% to about 40% of the cell density adjacent the outer layer(s). For example, for a cell size of about 2 mm×2 mm and for a 10 mm$^2$ sheet, the cell density adjacent the outer layers can be 6 while the cell density at the middle can be 3. For a cell size of about 2 μm×2 μm and for a 10 mm$^2$ sheet, the cell density adjacent the outer layers can be 2.5×10$^6$, while the cell density at the middle can be 400,000.

The sheet, for example each wall and transverse layer, individually, comprises the same or a different polymeric layer material. Exemplary polymeric layer materials comprise thermoplastics including polyalkylenes (e.g., polyethylene, polypropylene, polyalkylene terephthalates (such as polyethylene terephthalate, polybutylene terephthalate)), polycarbonates, acrylics, polyacetals, styrenes (e.g., impact-modified polystyrene, acrylonitrile-butadiene-styrene, styrene-acrylonitrile), poly(meth)acrylates (e.g., polybutyl acrylate, polymethyl methacrylate), polyetherimide, polyurethanes, polyphenylene sulfides, polyvinyl chlorides, polysulfones, polyetherketones, polyether etherketones, polyether ketone ketones, and so forth, as well as combinations comprising at least one of the foregoing. Exemplary thermoplastic blends comprise acrylonitrile-butadiene-styrene/nylon, polycarbonate/acrylonitrile-butadiene-styrene, acrylonitrile butadiene styrene/polyvinyl chloride, polyphenylene ether/polystyrene, polyphenylene ether/nylon, polysulfone/acrylonitrile-butadiene-styrene, polycarbonate/thermoplastic urethane, polycarbonate/polyethylene terephthalate, polycarbonate/polybutylene terephthalate, thermoplastic elastomer alloys, nylon/elastomers, polyester/elastomers, polyethylene terephthalate/polybutylene terephthalate, acetal/elastomer, styrene-maleic anhydride/acrylonitrile-butadiene-styrene, polyether etherketone/polyethersulfone, polyethylene/nylon, polyethylene/polyacetal, and the like. However, in the specific embodiment illustrated, it is envisioned a polycarbonate material is employed, such as those designated by the trade name Lexan®, which are commercially available from the General Electric Company, GE Plastics, Pittsfield, Mass.

Additives can be employed to modify the performance, properties, or processing of the polymeric material. Exemplary additives comprise antioxidants, such as, organophosphites, for example, tris(nonyl-phenyl)phosphite, tris(2,4-di-t-butylphenyl)phosphite, bis(2,4-di-t-butylphenyl) pentaerythritol diphosphite or distearyl pentaerythritol diphosphite, alkylated monophenols, polyphenols and alkylated reaction products of polyphenols with dienes, such as, for example, tetrakis[methylene(3,5-di-tert-butyl-4-hydroxyhydrocinnamate)]methane, 3,5-di-tert-butyl-4-hydroxyhydrocinnamate octadecyl, 2,4-di-tert-butylphenyl phosphite, butylated reaction products of para-cresol and dicyclopentadiene, alkylated hydroquinones, hydroxylated thiodiphenyl ethers, alkylidene-bisphenols, benzyl compounds, esters of beta-(3,5-di-tert-butyl-4-hydroxyphenyl)-propionic acid with monohydric or polyhydric alcohols, esters of beta-(5-tert-butyl-4-hydroxy-3-methylphenyl)-propionic acid with monohydric or polyhydric alcohols; esters of thioalkyl or thioacyl compounds, such as, for example, distearylthiopropionate, dilaurylthiopropionate, ditridecylthiodipropionate, amides of beta-(3,5-di-tert-butyl-4-hydroxyphenyl)-propionic acid; fillers and reinforcing agents, such as, for example, silicates, fibers, glass fibers (including continuous and chopped fibers), mica and other additives; such as, for example, mold release agents, UV absorbers, stabilizers such as light stabilizers and others, lubricants, plasticizers, pigments, dyes, colorants, anti-static agents, blowing agents, flame retardants, impact modifiers, among others.

The specific polymer can be chosen to provide a desired light transmission. For example, the polymer can provide a transmission of visible light of greater than or equal to about 70%, or, more specifically, greater than or equal to about 80%, even more specifically, greater than or equal to about 85%, as tested per ISO 9050. The solar spectrum from 300 nanometers (nm) to 2,500 nm is considered. The light transmission was numerically predicted by integrating over the wavelength as specified in ISO 9050.

The multiwall sheets can be formed using an extrusion process.

The following examples are merely exemplary, not intended to limit the multiwall sheets disclosed herein.

EXAMPLES

Example 1: U-Value

Multiwall sheet as illustrated in FIGS. 8-12 can be numerically predicted for density, stiffness, U-value, and light transmission. All of these multiwall sheets can be formed from polycarbonate. The multiwall sheet of FIG. 8, Sample 1, has 1.0 mm thick outer walls, 0.1 mm thick inner walls and transverse dividers, 17 layers, a cell size of 2 mm×2 mm, and a number of cells of 16 by 20. The multiwall sheet of FIG. 9, Sample 2, has 1.0 mm thick outer walls (outer layers), 0.1 mm thick inner walls and perpendicular transverse dividers, 9 layers, a cell size of 3.2 mm by 2 mm, and a number of cells of 8 by 20. The multiwall sheet of FIG. 10, Sample 3, has 1.0 mm thick outer walls (outer layers), 0.1 mm thick inner walls and perpendicular and X transverse dividers, 11 layers, a cell size of 3.2 mm by 2 mm, and a number of cells of 10 by 20. The multiwall sheet of FIG. 11, Sample 4, has 0.8 mm thick outer walls, 0.1 mm thick inner walls and perpendicular and X transverse dividers, 11 layers, a cell size of 4 mm by 2 mm, and a number of cells of 10 by 20. The multiwall sheet of FIG. 12, Sample 5, has 1.0 mm thick outer walls, 0.2 mm thick inner walls and X transverse dividers, and 0.45 mm thick perpendicular transverse dividers, 5 layers, and a number of cells of 5 by 2.

TABLE

| Sample | Density kg/m$^3$ | Weight (Kg/m$^2$) | Stiffness (N/mm) | Stiffness ratio | U-value (W/m$^2$K) | No. air gaps | Lt Trans.[1] | Lt Trans.[2] |
|---|---|---|---|---|---|---|---|---|
| 1 | 194 | 6.21 | 6,420 | 1.92 | 0.885 | 16 | 0.2325 | 0.6072 |
| 2 | 159 | 5.10 | 6,233 | 1.87 | 1.064 | 8 | 0.4280 | 0.7560 |
| 3 | 180 | 5.76 | 6,711 | 2.01 | 0.994 | 10 | 0.3631 | 0.7070 |
| 4 | 166 | 5.32 | 6,690 | 2.00 | 0.996 | 10 | 0.3631 | 0.7070 |
| 5 | 166 | 5.32 | 3,333 | 1.0 | 1.4 | 5 | 0.3800 (std) | 0.3800 |

[1]Lt Trans. = light transmission (τ) where T = 0.88 and R = 0.12 is a typical transmission and reflection coefficient of LEXAN sheet.
[2]Lt Trans. = light transmission (τ) where T = 0.96 and R = 0.04 is the proposed light transmission (T) and reflection (R) of the proposed nano structured or anti reflection coated walls.

Not to be limited by theory, it is believed that the number of gaps increases the resistance to convective heat transfer component of the U-value, wherein reducing to a cell size of less than 2 mm reduces the convective heat transfer component significantly. Also, cell size with spatially distributed density increases the sheet stiffness. This increase in the number of cells reduces the light transmission, which can be enhanced with a light transmission coating and/or structures.

As you can see from the Table, Samples 1-4 exhibited substantial improvement in stiffness (e.g., greater than 80% improvement in stiffness ratio, with a stiffness of greater than or equal to about 5,000 N/mm, or, more specifically, greater than or equal to about 6,000 N/mm, and even more specifically, greater than or equal to about 6,200 N/mm). The enhancement in structural integrity and light transmission was attained while retaining a U-value of less than or equal to 0.750 W/m$^2$K, and even less than or equal to 0.500 W/m$^2$K.

The stiffness was calculated numerically by simulating a typical uniaxial compression or tensile test. This provides input on tensile and compressive performance of the multiwall sheet. The flexural rigidity is a derived property from tensile or compressive stiffness.

Example 2: Stiffness

Figure 13:
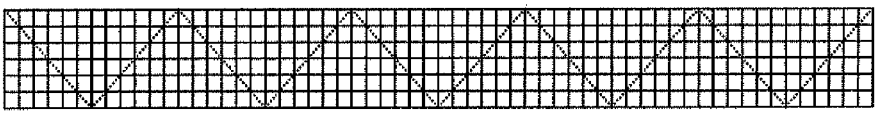
FIGS. 13 and 14 are cross-sectional side views of a 7 layer multiwall sheet configuration illustrating the multiwall sheet employed for Samples 6 and 7, respectively, in the Examples.
Figure 14:
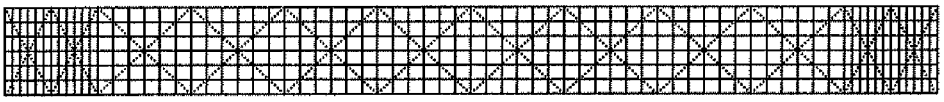

Sheets as illustrated in FIGS. 13 and 14 can be evaluated for flexural performance by numerical simulation for span of 1,200 mm and a loading of 1,200 newtons per square meter (N/m$^2$). Sample 6, FIG. 13, had a density of 84 kg/m$^3$ and a maximum deflection of 7.764 mm. Sample 7, FIG. 14, had a density of 85 kg/m$^3$ and a maximum deflection of 4.785 mm. Comparison of Sample 7 and Sample 8 shows that the spatially controlled sheet (Sample 8) is 38% stiffer.

Figure 15:
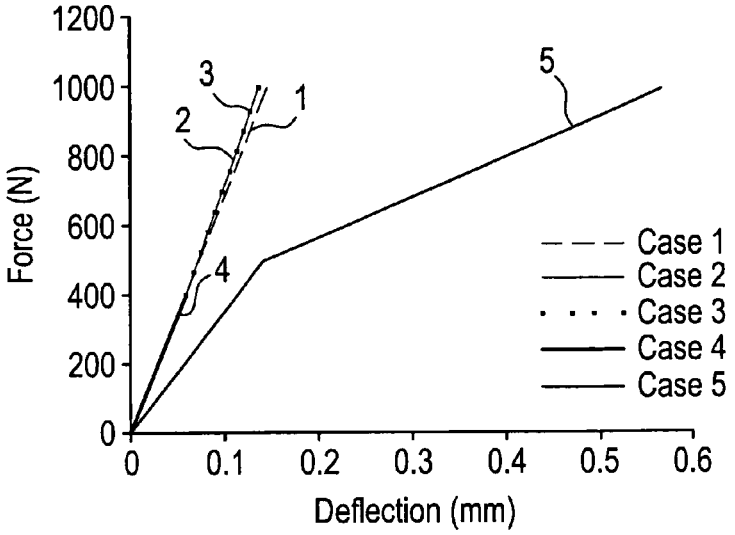
FIG. 15 is a graphical representation of a load versus deflection curve for the multiwall sheets of FIGS. 8-12.

Furthermore, as is illustrated in FIG. 15, a substantial improvement in stiffness has been attained. As can be seen from the figure, Samples 1-4 (lines 1-4 respectively) exhibited substantially the same stiffness, i.e., a stiffness twice as great as Sample 5 (line 5).

Figure 16:
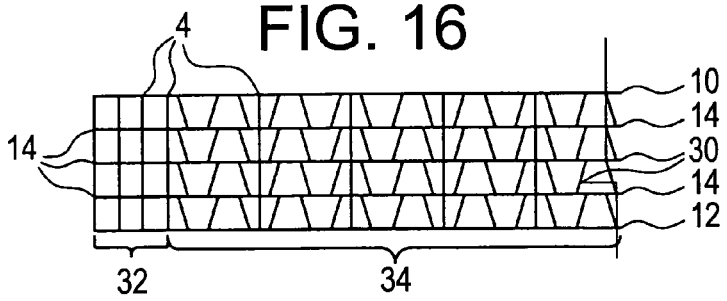
FIG. 16 is a cross-sectional side view of an exemplary embodiment of a 5 layer multiwall sheet having a cell size gradient.
Figure 17:
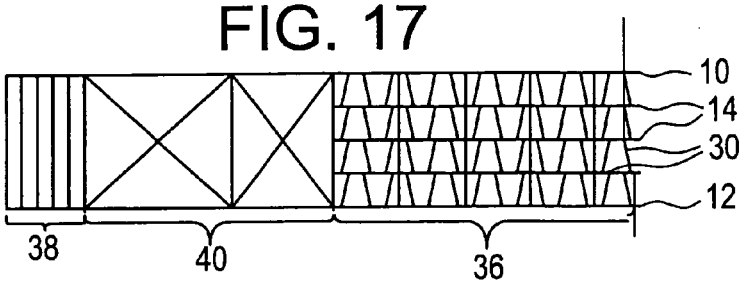
FIGS. 17 and 18 are cross-sectional side views of an exemplary embodiment of a 5 layer multiwall sheet having portions comprising 2 layers and portions comprising a different number of transverse layers and different number and shape of dividers, and including a cell size gradient.
Figure 18:
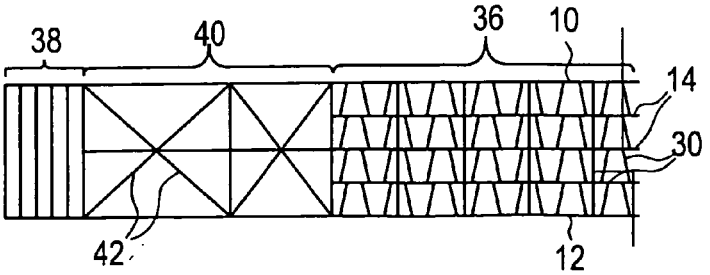

FIGS. 16-18 illustrate other embodiments comprising a non-uniform cell density. In FIG. 16, even though there are several inner layers 14, dividers 30 extend only from one polymer wall to an adjacent polymer wall to engage the polymer wall in a non-perpendicular fashion. Multiple dividers 30 are located between adjacent transverse layers 4. Near an end 32 of the multiwall sheet, the transverse layers 4 are located closer together (optionally with no dividers 30) than in a central portion 34 of the multiwall sheet.

Dividers 30 are also illustrated in a central portion of FIGS. 17 and 18, with different configurations of dividers and transverse layer(s) employed in other portions thereof, namely the end portion 38 and the intermediate portion 40. In this embodiment, the end and intermediate portions 38,40 comprise only the outer layers 10,12 (e.g., a 2 layer multiwall sheet) and no inner layers 14, while the central portion comprises interlayers 14. FIG. 17 has various spatially controlled areas to attain a desired structural integrity and insulative properties. Hence, in addition to having a cell size gradient, the sheet can have different numbers of inner layer(s), transverse layer(s), and/or dividers, in different portions of the sheet. Additionally, or in the alternative, the different portions can have different types of divider(s). For example, in FIG. 18, both dividers that extend across more than two layers; e.g., from the outer layer 11 to the outer layer 12 (intercell dividers 42) and dividers that only extend between adjacent layers (intracell dividers 30) are employed in different portions 36,40. In portion 38, only transverse layers are employed, with no inner layers or dividers.

It is also noted that although the present multilayer sheeting is specifically discussed with relation to naturally lit structures (e.g., greenhouses, sunrooms, and pool enclosures), the polymeric sheeting can be envisioned as being employed in any application wherein a polymer sheet is desired having a multiwall design. Exemplary applications comprise sunroofs, canopies, shelters, windows, lighting fixtures, sun-tanning beds, stadium roofing, and so forth.

Ranges disclosed herein are inclusive and combinable (e.g., ranges of "up to about 95 wt %, or, more specifically, about 5 wt % to about 20 wt %", is inclusive of the endpoints and all intermediate values of the ranges of "about 5 wt % to about 25 wt %," etc.). "Combination" is inclusive of blends, mixtures, alloys, reaction products, and the like. Furthermore, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the state value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant (s) includes one or more colorants). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A multiwall sheet, comprising:

non-intersecting polymer walls comprising outer layers; and transverse layers, wherein the transverse layers extend perpendicular and intersect the polymer walls, wherein only the transverse layers and polymer walls define cells;

wherein the multiwall sheet has a non-uniform cell density; and a U-value of less than or equal to about 1.2 $W/m^2K$ at a nominal volume density of less than or equal to about 180.

2. The multiwall sheet of claim 1, wherein the U-value is less than or equal to about 1.0 $W/m^2K$.

3. The multiwall sheet of claim 1, wherein the cell density in a middle of the sheet is about 10% to about 60% of a cell density adjacent the outer layers.

4. The multiwall sheet of claim 3, wherein the cell density in a middle of the sheet is about 15% to about 50% of the cell density adjacent the outer layers.

5. The multiwall sheet of claim 4, wherein the cell density in a middle of the sheet is about 20% to about 40% of the cell density adjacent the outer layers.

6. The multiwall sheet of claim 1, further comprising a cell size gradient such that the cell size increases toward a center of the multiwall sheet.

7. The multiwall sheet of claim 6, wherein the cells have a decreasing size from the middle to toward the ends of the sheet.

8. The multiwall sheet of claim 6, wherein the cells have a decreasing size from the middle to toward the outer layers.

9. The multiwall sheet of claim 1, wherein the transverse layers have a thickness of about 0.1 mm to about 1 mm.

10. The multiwall sheet of claim 1, wherein the polymer walls comprise micro-features and/or nano-features.

11. The multiwall sheet of claim 1, wherein the transverse layers comprise micro-features and/or nano-features.

12. The multiwall sheet of claim 1, wherein the cells have a length and/or width of less than or equal to about 2 mm.

13. A multiwall sheet, comprising:

non-intersecting polymer walls comprising outer layers; and transverse layers, wherein the transverse layers extend perpendicular and intersect the polymer walls, wherein only the transverse layers and polymer walls define to form cells; and wherein the multiwall sheet has a non-uniform cell density and comprises a stiffness of greater than or equal to about 4,000 N/mm.

14. The multiwall sheet of claim 13, wherein the stiffness is greater than or equal to about 5,000 N/mm.

* * * * *